United States Patent [19]

Nofel

[11] 4,161,639

[45] Jul. 17, 1979

[54] HANDLE SAFETY SWITCH

[75] Inventor: Thomas J. Nofel, Brookpark, Ohio

[73] Assignee: MTD Products Inc., Cleveland, Ohio

[21] Appl. No.: 812,178

[22] Filed: Jul. 1, 1977

[51] Int. Cl.[2] ..... H01H 9/06; H01H 13/08

[52] U.S. Cl. ..... 200/157; 123/198 DC

[58] Field of Search ..... 200/61.85, 157; 123/198 DC; 180/19 R, 19 H, 82 R, 99

[56] References Cited

U.S. PATENT DOCUMENTS

| | | | |
|---|---|---|---|
| 962,989 | 6/1910 | Stevens | 200/61.85 X |
| 2,128,916 | 9/1938 | Cox | 180/99 X |
| 3,167,146 | 1/1965 | Rudolph | 180/19 R |
| 3,942,604 | 3/1976 | Black | 200/157 X |
| 3,980,068 | 9/1976 | Karsten et al. | 200/157 X |

*Primary Examiner*—Herbert F. Ross

*Attorney, Agent, or Firm*—Woodling, Krost, Granger & Rust

[57] ABSTRACT

A safety switch mechanism mounted on the handle of a power driven appliance such as a snow-thrower, lawn mower, garden tiller and the like having a motor or engine mounted thereon, the operator walking behind the appliance for holding a backwardly extending handle, the switch mechanism being adapted to short out or ground the electrical circuit of the motor or engine, or alternatively to open the contacts of a solenoid connected in series with the energizing circuit of an electric motor so as to stop the operation of the same upon the operator discontinuing to grasp the switch mechanism on the handle. This is an abstract only of the specific illustration of the invention given by way of example and is not to be used in the interpretation of the claims nor as a limitation on the scope of the invention.

6 Claims, 8 Drawing Figures

HANDLE SAFETY SWITCH

An object of the invention is to lend safety in the operation of a power driven appliance, such as a snow-thrower, lawn mower, garden tiller and the like having a motor or engine mounted on the appliance.

It is an object of my invention to assure that upon the operator of the appliance releasing his grasp upon the portion of the handle normally held by the operator walking behind the appliance, the operation of the motor or engine of the appliance will terminate.

Another object is to assure that the switch mechanism mounted on the handle of such a power driven appliance will cause the motor or engine of the appliance to stop operating unless the switch mechanism is grasped at least some place along the length of the portion of the handle normally held by the operator.

A still further object in one form of the invention is the provision of an elongated hand grasping member housing a normally closed switch for controlling the operation of a motor or engine, constructed to provide that the switch is maintained to keep closed an electrical circuit unless the hand grasping member is grasped at least at some location along its length.

Another object in a modified form of the invention is the provision of an elongated hand grasping member housing a normally open switch for controlling the operation of an electric motor, constructed to provide that the switch is maintained open unless the hand grasping member is grasped at least at some location along its length, the said switch being connected in series with a control solenoid circuit which controls the completion of the circuit carrying the energizing current of the electric motor.

Other objects and a fuller understanding of this invention may be had by referring to the following description and claims, taken in conjunction with the accompanying drawings in which:

Figure 1:
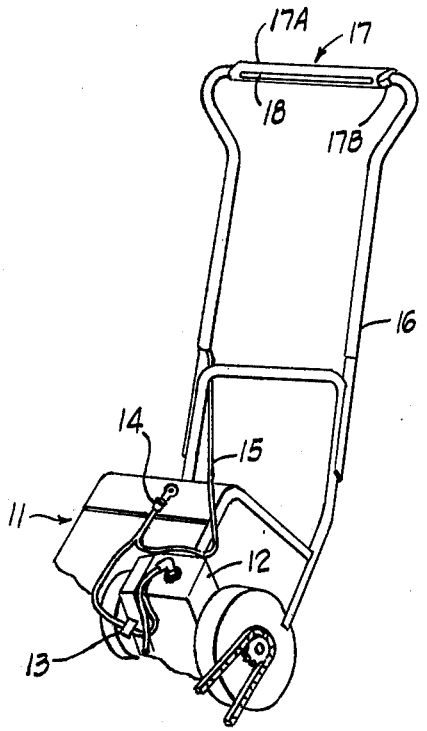
FIG. 1 is a perspective view of a power driven appliance such as a snow-thrower, lawn mower, garden tiller or the like, and to which my invention is applied.
Figure 3:
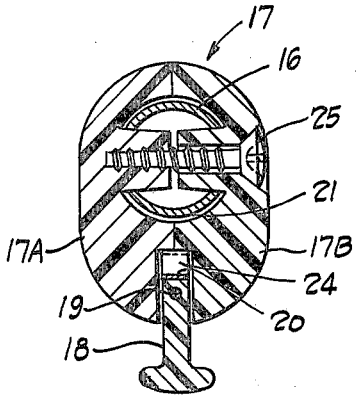
FIG. 3 is an enlarged cross-sectional view taken through the line 3—3 of FIG. 2.
Figure 2:
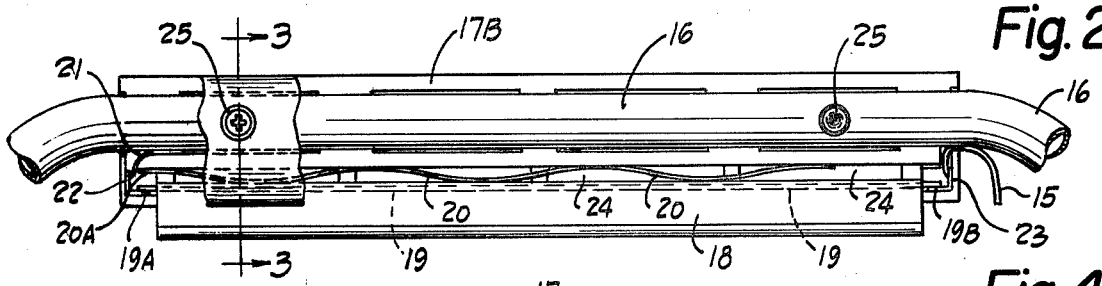
FIG. 2 is a longitudinal cross-sectional view of the hand grasping portion embodying my switch mechanism and applied to the portion of the appliance handle normally grasped or held by the operator, and in which the switch is resiliently held in closed position at both of its opposite ends.
Figure 4:
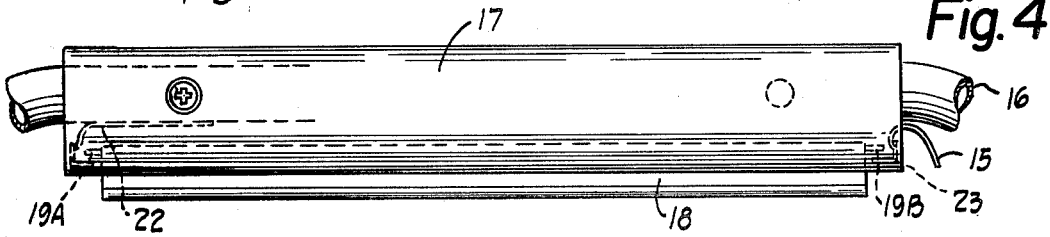
FIG. 4 is a top view of the hand grasping member embodying my improved switch mechanism and showing the mechanism operated so that the contacts are open at both of the opposite ends of the switch mechanism.
Figure 5:
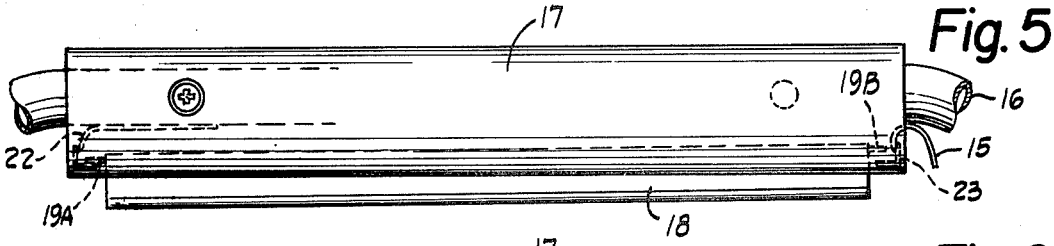
FIG. 5 is a view similar to that of FIG. 4 but in which the contacts at one of the opposite ends of the switch mechanism are closed and at the other of the opposite ends are opened.
Figure 6:
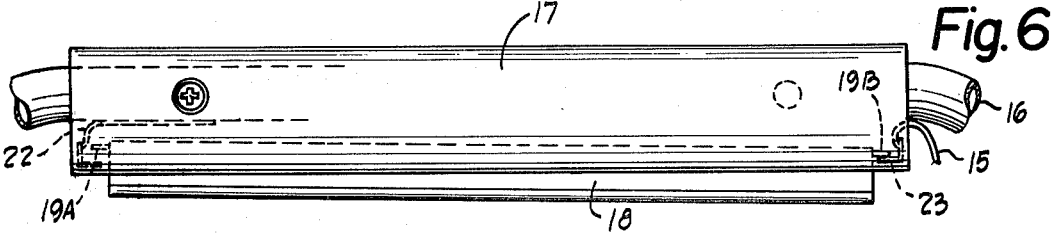
FIG. 6 is a view similar to that of FIG. 4 but in which the contacts at one of the opposite ends of the mechanism are opened, while at the other of the opposite ends the contacts are closed.

In FIG. 2 the upper portion of the hand grasping member has largely been removed to disclose the details of the switch mechanism mounted within the hand grasping member. In FIGS. 4, 5 and 6, the hand grasping member is enclosed and the internal switch mechanism parts are shown in phantom. In FIG. 1 it is shown that the hand grasping member, which is an elongated member, is mounted on the transverse portion of the appliance handle which is normally held by the operator walking behind the appliance in its forward travel.

The appliance to which my invention is mounted may be a power driven snow-thrower, lawn mower, garden tiller or the like which is driven by an internal combustion engine or an electric motor. Such appliances usually have rearwardly extending handles held by the operator who walks behind the appliance as it moves forwardly.

In the drawing, the power driven appliance is generally denoted by the reference character 11. A motor or engine 12 is mounted upon the appliance in the well known manner to drive the appliance and operating parts carried thereby. In the instance illustrated, the motor or engine 12 is an internal combustion engine having an ignition system including a magneto. Upon shorting out or grounding the ignition system of the engine 12, the engine is stopped and the appliance is no longer driven. The connection of the grounding circuit to the engine is indicated by the reference character 13. Leading from this connection 13 is an insulated wire 15 which goes through a key operated switch 14 in the usual manner. The wire 15 extends upwardly and is encased in a plastic sheath enclosing the upper exposed portion of the handle 16 extending rearwardly from the appliance.

The handle 16 has a bight extending transversely relative to the direction of the mower travel and which bight is normally held by the operator of the appliance. Mounted upon this transverse bight of the handle is a hand grasping member 17. This member 17 is of suitable molded plastic material of electric insulating material. It is comprised of two mating parts 17A and 17B and extends along the transverse bight of the handle as illustrated. The two parts 17A and 17B are held together by screws 25 which extend through suitably provided openings in the bight of the handle 16 whereby the hand grasping member 17 is firmly secured to the handle bight.

Along the forward and lower portion of the member 17 there is provided a long recess or groove 24 extending along most, but not all, of the length of the member 17. Positioned in this long recess or groove 24 is a bar 18 also of plastic electrically insulating material. This bar 18 extends outwardly so as to be engaged by the hand of the operator grasping the member 17. Extending through the length of the bar 18 is a conducting member 19 which protrudes from the opposite ends of the bar 18 to have end portions 19A and 19B protruding therefrom. At one end of the member 17, such as at the left-hand end in FIGS. 2, 4, 5 and 6, there is electrically contacting member 22 mounted in fixed position therein. This electric contacting member 22 is electrically connected to the metal handle 16 within the member 17 by a small wire 21 which is disposed along and is pressed against the bare metal of the handle 16 within the member 17 whereby the contact member 22 is grounded or electrically connected with the handle 16 and the metal frame of the appliance 11 and engine 12.

At the opposite end of the member 17, such as at the right-hand end in FIGS. 2, 4, 5 and 6, there is mounted in fixed position an electrically contacting member 23. This fixed electric contact member 23 is electrically connected with the wire 15 which, as shown in FIG. 1, extends down to the magneto connection 13 of the engine 12. Thus, at one end of the member 17 the contact member 22 is grounded and at the other end of the member 17, the contact member 23 is connected to the grounding circuit through wire 15 to the magneto connection 13.

Mounted within the long recess or groove 24 formed within the two mating halves 17A and 17B is a spring of wave form. It is so resiliently biased that it tends to assume the wavy form illustrated in FIG. 2. As noted in this Figure, there are three locations of engagement of the spring 20 with the inner edge of the bar 18. There are also three locations of engagement of the spring 20 with the back wall of the recess 24. The locations of the engagement of the spring with the bar 18 and the locations of the engagement of the spring 20 with the back wall of the recess 24 against which the spring is pressed are out of phase with each other as illustrated.

The left-hand end of the spring 20 is anchored or held in the position shown by a small nitch or recess formed in the opposite mating halves 17A and 17B. As seen in FIG. 2, this end is at the left-hand end of the member 17 whereby this left-hand end of the spring 20 is held against the rear wall of the recess within the member 17. As this nitch is small and coincides with the dimension of the spring at the left-hand end, the nitch itself is not discernible in the view of FIG. 2. The right-hand end of the spring 20 in FIG. 2 is free so that the right-hand end may slide longitudinally as the spring is compressed by the bar 18 moved inwardly of the member, that is rearwardly of the appliance as it moves forwardly.

The bias of the spring 20 is such that upon the operator seizing with a hand the member 17 so as to press the bar 18 inwardly of the member 17, that is rearwardly in respect to forward motion of the appliance, the bar 18 is permitted to move and to carry with it conducting member 19 and protruding ends 19A and 19B. When the handle is not held so that the operator's hand moves the bar 18 rearwardly, or inwardly of the member 17, then the bar 18 is held out from the member 17 by the resilient force of the spring 20. When the member 17 is not so grasped as to move the bar rearwardly into the member 17, then the parts are in the relative position illustrated in FIG. 2. Here it will be seen that protruding end 19A of the conducting member 19 engages the contact member 22 and also the protruding end 19B of conducting member 19 electrically engages the contact member 23 at the right-hand end in FIG. 2.

In this condition of the parts shown in FIG. 2, there is a complete circuit between ground and the magneto connection whereby the engine or motor 12 can not operate because the circuit is grounded out. Thus, in the unattended condition of the appliance wherein the operator is not holding in one or both hands the member 17 so as to press the bar 18 inwardly, the engine can not be started, or if it is already operating, the engine will be stopped. Thus the safety of the operator is assured because the appliance can not be operated unless and until the operator is behind the handle and holding the hand grasping member 17 so as to press the bar 18 inwardly.

Upon the bar being pressed inwardly of the member 17 so that there is substantial equilibrium in the force of moving the opposite ends of the bar 18 inwardly, then the parts will be in the position illustrated in FIG. 4. Here both contacts in the opposite ends of the hand grasping member 17 are opened and the grounding circuit is opened so that the engine may be operated. It is noted here by the phantom lines that the protruding ends 19A and 19B are spaced from the contacting members 22 and 23, respectively, so that the grounding circuit is broken at two different locations. This would be normally the situation where the operator so grasps the member 17 as to so press the bar 18 inwardly to move both ends of the bar 18 to the position shown in FIG. 4.

In FIG. 5 there is illustrated the relationship of the parts as the member 17 is so grasped as to press inwardly the bar 18 only at one of the opposite ends of the member 17 such as at the right-hand end illustrated in FIG. 5. In this situation the bias of the spring is such that the grounding circuit is broken at this one end of the member 17, that is, the right-hand end in FIG. 5, but the grounding circuit remains closed at the left-hand end shown in FIG. 5. Thus, the grounding circuit will be opened so as to be ineffective and not to stop or limit the operation of the engine if the bar 18 is moved only to the limited extent shown in FIG. 5.

In FIG. 6 it is assumed that the operator has so grasped the handle 17 as to move the bar at the left-hand end of FIG. 6 inwardly of the member 17 so as to move the protruding end 19A out of contact with the contacting member 22 while at the same time the protruding end 19B remains in contact with the contacting member 23 at the right-hand end shown in FIG. 6. Here again, the grounding circuit is opened at only one location but this is enough to keep the grounding circuit from being effective and to permit the engine to operate.

It is thus seen that the switch mechanism is effective whether the bar is moved rearwardly as in FIG. 4 and in which the bar 18 is kept parallel with the member 17, or is effective when the bar is tilted as illustrated in FIG. 5, or is tilted in an opposite menner as illustrated in FIG. 6. As long as the operator moves the bar 18 rearwardly, that is inwardly of the member 17, into positions of either FIGS. 4, 5 or 6, the grounding circuit will be broken or opened so as to be ineffective and the motor or engine may operate without it being grounded. However, if the handle 18 is not moved inwardly of the member 17 by the operator so as to be completely pressed forwardly to the position shown in FIG. 2, then the grounding circuit is closed at two locations and the engine is effectively grounded at the magneto connection 13.

Figure 7:
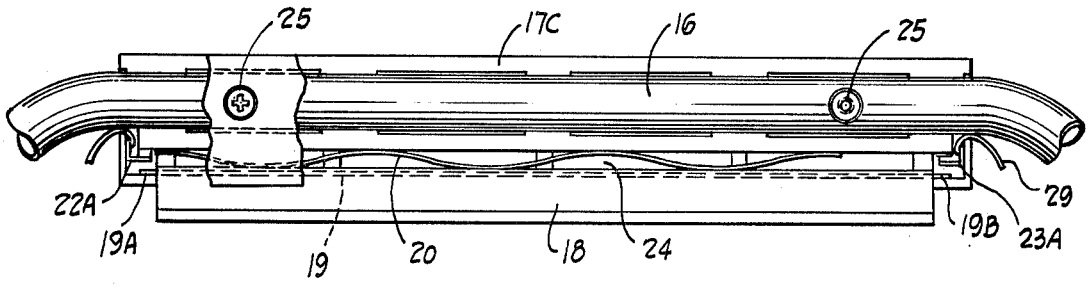
FIG. 7 is a view somewhat similar to that of FIG. 2 but showing a modified arrangement in which the electric contact members are so located and arranged that the switch mechanism is normally open.
Figure 8:
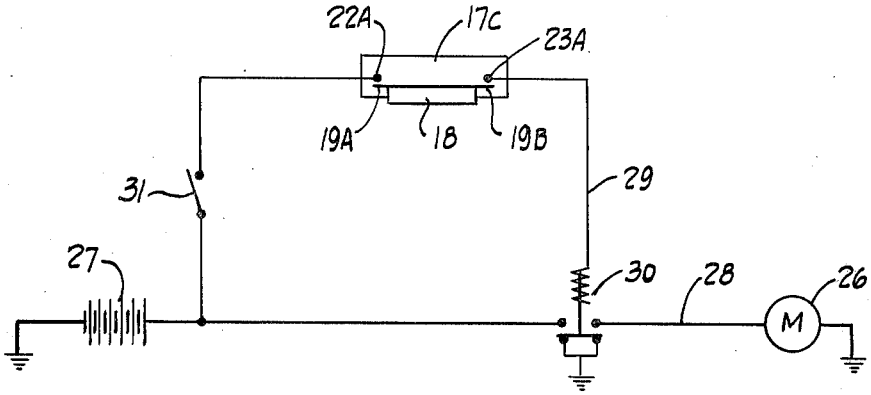
FIG. 8 is a circuit diagram showing the application of the normally open switch mechanism shown in FIG. 7 to an appliance having an electric motor for driving the same.

In the modified form of my invention illustrated in FIGS. 7 and 8, the hand grasping member 17C is similar to the preferred form of member 17 illustrated in FIGS. 1–6, except that the switch mechanism within the member 17C is normally open when the member 17C is not grasped and the bar 18 moved inwardly by the hand of the operator.

In this modified form of the invention, the form and positions of the electric contact members are changed so that in FIG. 7 contact member 22 is here designated as 22A and contact member 23 is here designated as 23A. These contact members 22A and 23A are connected in series in the control circuit 29 as illustrated in FIG. 8. The spring 20 resiliently holds the end portions 19A and 19B of conducting member 19 away from, that is out of electrical engagement with, the contact members 22A and 23A, respectively.

The modified form of the invention is particularly adapted for use in controlling the operation of an electric motor which may be mounted on an appliance, such as a snow-thrower, lawn mower, garden tiller, or the like, for driving the same. FIG. 8 is a diagrammatic view showing such a modified member 17C connected in series with a control circuit for opening and closing the circuit carrying the main electric current that energizes the electric motor 26.

A battery 27, or other suitable course of electric current such as house current, supplies the main electric current for energizing the motor 26 through conducting cable 28. A controlling electric circuit 29 is electrically connected to the battery 27 and to a solenoid switching device 30 which is connected to cable 28 between battery 27 and motor 26 so as to control the flow of current between the battery 27 and motor 26 through the cable 28. When the solenoid switching device 30 is in opened position, current supply to the motor 26 is interrupted and the operation of the motor terminates.

A key-operated switch 31 is connected in series in the control circuit 29 as shown in FIG. 8. Also the modified hand grasping member 17C containing the normally open switch mechanism, including contact members 22A and 23A, is connected in series in the control circuit 29.

Upon the member 17C being grasped by the operator to press the bar 18 inwardly to complete a connection between contacts 22A and 23A (assuming the key operated switch has been closed by the key) the control circuit 29 is completed. This operates the solenoid operated switch 30 which closes that switch to complete and maintain the circuit through cable 28 between battery 27 and electric motor 26. The motor 26 is thus energized and operates.

Upon the release of the member 17C by the operator of the appliance, then the switch mechanism within the member 17C resumes its normally open condition and the solenoid in solenoid switching device 30 is no longer energized and the switching device 30, biased to open position, is opened and the supply of current through the cable 28 to the motor 26 from battery 27 is terminated. The motor 26 then ceases to operate because the member 17C is no longer grasped by the operator so as to hold the bar 18 inwardly. Upon both ends of bar 18 of the modified switch mechanism in the member 17C being held inwardly by the operator pressing the whole bar 18 inwardly, the control circuit 29 is completed and the solenoid switching device 30 is closed to cause current to flow from the battery 27 to the motor 26 which is then energized.

It will be seen that this modified form of the invention is thus well adapted for controlling the operation of an electric motor.

It will be seen that considerable safety is assured by the application of my invention to such appliance as power driven snow-throwers, lawn mowers, garden tillers and the like.

The present disclosure includes that contained in the appended claims, as well as that of the foregoing description.

Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and the scope of the invention as hereinafter claimed.

What is claimed is:

1. A safety switch for controlling the operation of a motor of an appliance having a handle held by the operator of the appliance while walking behind the appliance, the combination of a hollow hand grasping member removably mounted on the handle in a position to be grasped by the operator, said hand grasping member having a slot along substantially the length thereof and a bar extending longitudinally therealong and protruding into said slot in said hand grasping member, a single serpentine resilient means carried by the hand grasping member in said slot along the length thereof and positioned to resiliently urge the said bar outwardly of the hand grasping member substantially equally along the length of the bar to permit the bar to move bodily relative to the hand grasping member and to permit the bar to tilt relative to the hand grasping member, electric contact members carried by the hand grasping member adjacent the opposite ends thereof, said electric contact members being electrically connected to said motor for the control of the operation of the motor, an electric conducting member within said bar and extending outwardly at each end of said bar to move therewith, said electric conducting member electrically engaging said contact members under the bias of said resilient means, the said bar urged outwardly of said hand grasping member under the bias of said resilient means holding said engaging portions of the electric conducting member in electric contact with both said electric contact members to close the circuit between said contact members, the movement of the said bar bodily inwardly of the hand grasping member along the length of the hand grasping member by the hand of the operator grasping the bar in opposition to the bias of said resilient means breaking the contact of both the engaging members with the contact members, respectively, to open the circuit between said contact members, and the tilting of the bar relative to the hand grasping member by the hand of the operator grasping the bar in opposition to the bias of said resilient means breaking the contact of at least one of the engaging members with a contact member to open the circuit between said contact members.

2. A safety switch as claimed in claim 1, wherein said resilient means is a spring strip in wave form and having a plurality of at least three locations of bearing engagement between the spring strip and the hand grasping member and having a plurality of at least three locations of bearing engagement between the spring strip and the bar, the spring strip being anchored adjacent one end of the hand grasping member and being elongatable upon movement of the said bar and hand grasping member toward each other.

3. A safety switch as claimed in claim 1 and in which the resilient means provides resilient resistance along the length of the hand grasping member to movement of the bar inwardly toward the hand grasping member and provides fulcrum support to the bar upon tilting of the bar relative to the hand grasping member.

4. An electric switch for controlling the operation of a motor of an appliance having a handle, a substantially straight hand grasping member removably mounted on the handle to assure the opening of an electric circuit connected to control the operation of said motor upon the operator ceasing to grip the hand grasping member, the hand grasping member having a slot therein extending therealong comprising in combination two spaced electric contact members carried by said hand grasping member and serially electrically connected in said circuit, a substantially straight bar, protruding into said slot and extending along said hand grasping member, the bar being positioned to be moved toward and away from said hand grasping member, electric conducting means extending through and carried by the bar, the electric conducting means including spaced electric engaging portions extending from opposite ends of said bar and adapted to engage and electrically connect the said electric contact members, respectively, to provide electric connection between them and to close the said electric circuit, a spring of wave form having a plurality of slidable bearing surfaces spaced apart longitudinally of said bar and said hand grasping member, said spring being positioned intermediate said bar and said hand grasping member and biased to resiliently urge the bar away from said hand grasping member, said spring permitting said bar by the grip of the operator to move bodily along its length toward and away from said hand grasping member to disengage both of the said electric engaging portions from said electric contact members for opening said electric circuit, and said spring also permitting said bar by the grip of the operator to tilt at an angle relative to said hand grasping member to disengage at least one of said electric engaging portions from one of said electric contact members also for opening said electric circuit.

5. An electric switch as claimed in claim 4 wherein said hand grasping member is hollow and embraces a straight end portion of the handle, said hand grasping member carrying said bar extended therealong, the said electric contact members being carried by the hand grasping member and positioned to limit movement of the bar away from said end portion of the handle.

6. An electric switch as defined in claim 5 and in which the spaced bearing surfaces of said spring alternately engage the said bar and the hollow hand grasping member longitudinally of the bar and hand grasping member.

* * * * *